US009874321B2

(12) United States Patent
Renk, Jr.

(10) Patent No.: US 9,874,321 B2
(45) **Date of Patent: *Jan. 23, 2018**

(54) FLASHLIGHT

(71) Applicant: Thomas Edward Renk, Jr., Indianapolis, IN (US)

(72) Inventor: Thomas Edward Renk, Jr., Indianapolis, IN (US)

( * ) Notice: Subject to any disclaimer, the term of this patent is extended or adjusted under 35 U.S.C. 154(b) by 240 days.

This patent is subject to a terminal disclaimer.

(21) Appl. No.: 14/728,048

(22) Filed: Jun. 2, 2015

(65) Prior Publication Data

US 2015/0260359 A1 Sep. 17, 2015

Related U.S. Application Data

(63) Continuation of application No. 13/656,125, filed on Oct. 19, 2012, now Pat. No. 9,052,072.

(60) Provisional application No. 61/550,140, filed on Oct. 21, 2011.

(51) Int. Cl.

| | |
|---|---|
| ***F21L 4/02*** | (2006.01) |
| ***F21V 23/04*** | (2006.01) |
| ***F21L 4/04*** | (2006.01) |
| *F21V 21/30* | (2006.01) |
| *F21Y 115/10* | (2016.01) |

(52) U.S. Cl.

CPC ..... *F21L 4/02* (2013.01); *F21L 4/022* (2013.01); *F21L 4/04* (2013.01); *F21V 23/0414* (2013.01); *F21V 21/30* (2013.01); *F21Y 2115/10* (2016.08)

(58) Field of Classification Search

None

See application file for complete search history.

(56) References Cited

U.S. PATENT DOCUMENTS

| | | | |
|---|---|---|---|
| 2,778,931 | A | 1/1957 | Cruz |
| 3,953,722 | A | 4/1976 | Stick |
| 4,286,311 | A | 8/1981 | Maglica |
| 4,459,646 | A | 7/1984 | Drane |
| 4,467,403 | A | 8/1984 | May |
| 4,495,550 | A | 1/1985 | Visciano |
| 4,937,713 | A | 6/1990 | Holt |
| 5,205,640 | A | 4/1993 | Shin |
| 5,345,370 | A | 9/1994 | Murray |
| 5,410,457 | A | 4/1995 | Parker |
| 5,530,633 | A | 6/1996 | Yuen |
| D371,855 | S | 7/1996 | Heun |
| 5,541,822 | A | 7/1996 | Bamber |
| 5,558,430 | A | 9/1996 | Booty, Jr. |
| 5,595,436 | A | 1/1997 | Way et al. |
| 5,816,684 | A | 10/1998 | Yu |
| 5,853,241 | A | 12/1998 | Sharrah |
| 5,859,582 | A | 1/1999 | Yuen |
| 5,876,110 | A | 3/1999 | Uke |
| 5,971,562 | A | 10/1999 | Yang |
| 5,993,022 | A | 11/1999 | Neyer |
| 6,012,824 | A | 1/2000 | Sharrah |
| 6,099,141 | A | 8/2000 | Landamia |
| 6,283,610 | B1 | 9/2001 | Alajajian |
| 6,641,279 | B1 | 11/2003 | Williams |
| 6,769,787 | B2 | 8/2004 | Ferguson |

(Continued)

*Primary Examiner* — Anh Mai
*Assistant Examiner* — Zachary J Snyder
(74) *Attorney, Agent, or Firm* — Barnes & Thornburg LLP

(57) ABSTRACT

A flashlight includes a body sized to be held in the hand of a user. The flashlight includes a light source coupled to the body for emitting light when the light source is activated by a user. The light source is movable to emit light as directed by the user.

29 Claims, 9 Drawing Sheets

(56) References Cited

U.S. PATENT DOCUMENTS

| | | | |
|---|---|---|---|
| 6,893,140 | B2 | 5/2005 | Storey |
| 6,913,370 | B2 | 7/2005 | Ping |
| 6,913,371 | B2 | 7/2005 | Ping |
| 6,955,446 | B2 | 10/2005 | Uke |
| 7,217,013 | B2 | 5/2007 | Endo |
| 7,222,986 | B2 | 5/2007 | Mah |
| 7,296,909 | B2 | 11/2007 | Van Deursen |
| 7,314,286 | B2 | 1/2008 | Sharrah |
| 7,318,657 | B2 | 1/2008 | Booty, Jr. |
| 7,364,320 | B2 | 4/2008 | Van Deursen |
| 7,401,941 | B2 | 7/2008 | Teng |
| 7,478,917 | B2 | 1/2009 | Yu |
| 8,197,083 | B2 | 6/2012 | Halasz |
| 8,262,246 | B2 | 9/2012 | Pelletier |
| 2004/0114358 | A1 | 6/2004 | Storey |
| 2005/0024863 | A1 | 2/2005 | Phipps et al. |
| 2005/0078476 | A1 | 4/2005 | Ping |
| 2006/0082321 | A1 | 4/2006 | Deursen et al. |
| 2006/0198133 | A1 | 9/2006 | Mah |
| 2007/0014103 | A1 | 1/2007 | Teng et al. |
| 2007/0109774 | A1 | 5/2007 | Booty, Jr. |
| 2008/0205036 | A1 | 8/2008 | Tarter et al. |
| 2008/0261456 | A1 | 10/2008 | Axland et al. |
| 2009/0168422 | A1 | 7/2009 | Chiu et al. |
| 2010/0039801 | A1 | 2/2010 | Pelletier |
| 2010/0182777 | A1 | 7/2010 | Van Deursen |
| 2010/0232147 | A1 | 9/2010 | Bryant et al. |
| 2010/0246167 | A1 | 9/2010 | D'Amato |
| 2010/0309656 | A1 | 12/2010 | O'Sullivan |
| 2011/0228524 | A1 | 9/2011 | Greer |
| 2011/0267807 | A1 | 11/2011 | Nelson et al. |
| 2012/0026727 | A1 | 2/2012 | Hajee et al. |
| 2012/0057335 | A1 | 3/2012 | Wang |
| 2013/0329412 | A1 | 12/2013 | Ko |

FLASHLIGHT

PRIORITY CLAIM

This application is a continuation of Ser. No. 13/656,125, filed Oct. 19, 2012, which claims priority under 35 U.S.C. §119(e) to U.S. Provisional Application Ser. No. 61/550,140, filed Oct. 21, 2011, which is expressly incorporated by reference herein.

BACKGROUND

The present disclosure relates to light sources. In particular, the present disclosure is directed to portable flashlights.

SUMMARY

According to the present disclosure, a flashlight includes a body sized to be held in the hand of a user. The flashlight includes a light source coupled to the body for emitting light when the light source is activated by a user.

In illustrative embodiments, a flashlight includes a body formed by a first light generator and a second light generator pivotable relative to one another about a pivot axis. In some embodiments, each light generator includes an axial light source and a movable light source. The axial light source projects light along the pivot axis. The movable light source projects light perpendicular to the pivot axis along a longitudinal axis of its corresponding light generator.

In some embodiments, the flashlight also includes prop means for supporting the first light generator and the second light generator of the body relative to a surface when the first light generator and the second light generator are arranged in preselected positions at an angle with the surface by a user. As a result, the first light generator and the second light generator continue to provide light in predetermined directions corresponding to the preselected positions without the user holding either light generator or the prop means.

In illustrative embodiments, the prop means includes an axle arranged to extend along the pivot axis and a support leg coupled to the axle. The first light generator and the second light generator are coupled to the axle with an interference fit so that each light generator pivots about the axle when acted on by a user and is held in place relative to the axle when released by the user. The support leg is situated between the light generators and is coupled to the to the axle with an interference fit so that the support leg pivots about the axle when acted on by a user and is held in place relative to the axle when released by the user.

In illustrative embodiments, the support leg pivots about the pivot axis from a stowed position to a use position. In the stowed position, the support leg is located between the first light generator and the second light generator. In the use position, the support leg is arranged to extend out from between the first light generator and the second light generator to support the first light generator and the second light generator when placed on a surface.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 9 is a bottom plan view of the flashlight of FIG. 1 showing that arm of the first light generator includes an optional tapped orifice so that the flashlight can be threadedly coupled to a keychain, a carabineer, or the like;

DETAILED DESCRIPTION

Figure 4:
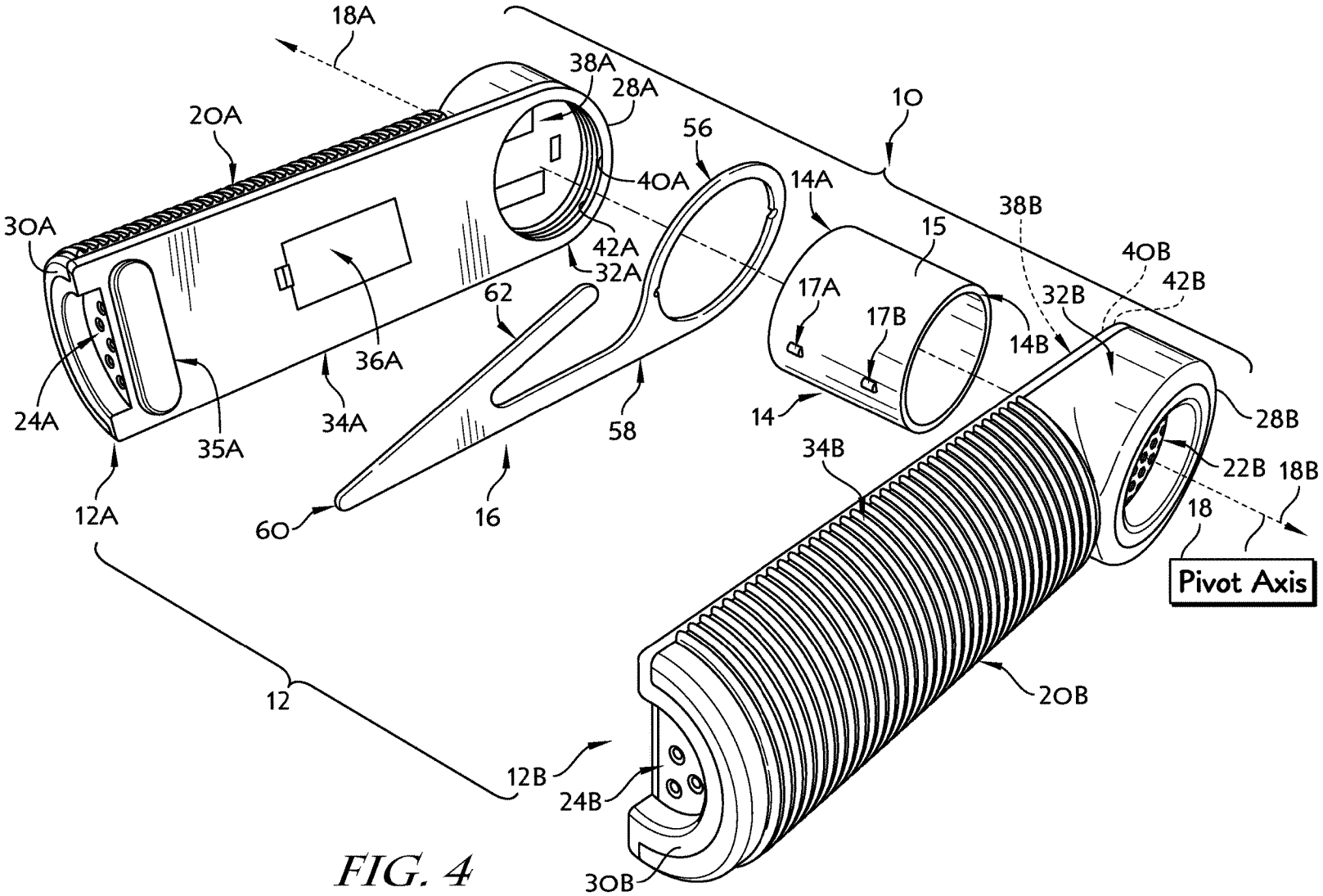
FIG. 4 is an exploded perspective view of the flashlight of FIG. 1 showing that the flashlight includes an axle defining the pivot axis about which the support leg, first light generator, and second light generator pivot.

An illustrative flashlight 10 includes a body 12, an axle 14, and an interchangeable support leg 16 as shown in FIG. 4. Body 12 is sized to be gripped by a user and generates light. Axle 14 is coupled to body 12 and extends through support leg 16. Support leg 16 pivots about a pivot axis 18 defined by axle 14 and provides a body-support means configured to support body 12 in a stationary position relative to a flat surface or the ground as selected by a user so that the user can aim a light stream generated by body 12 in a predetermined direction as shown, for example, in FIG. 2.

Body 12 of the illustrative embodiment includes a first light generator 12A and a second light generator 12B as shown in FIG. 4. Body 12 is sized so that light generators 12A, 12B can be gripped together or independently by a user. Each light generator 12A, 12B includes an arm 20A, 20B, an axial light source 22A, 22B, a movable light source 24A, 24B, and a power system 26A, 26B. Arms 20A, 20B are coupled to axle 14 and each arm 20A, 20B is independently pivotable over 360° about pivot axis 18. Axial light sources 22A, 22B are supported by arms 20A, 20B at a proximal end 28A, 28B of arms 20A, 20B along pivot axis 18. Movable light sources 24A, 24B are supported by arms 20A, 20B at a distal end 30A, 30B of arms 20A, 20B. Power systems 26A, 26B are configured to activate and deactivate axial light sources 22A, 22B and movable light sources 24A, 24B as desired by a user.

Arms 20A, 20B include a hub section 32A, 32B, an extension section 34A, 34B, and a battery door 36A, 36B. Hub sections 32A, 32B support axial light sources 22A, 22B and each hub section 32A, 32B receives an end 14A, 14B of axle 14 so that arms 20A, 20B can pivot independently about pivot axis 18 defined by axle 14. Extension sections 34A, 34B extend from hub sections 32A, 32B perpendicular to pivot axis 18 and support movable light sources 24A, 24B. Battery doors 36A, 36B are removably coupled to extension sections 34A, 34B and allow access to power systems 26A, 26B that are housed in arms 20A, 20B.

Arms 20A, 20B each also include a pad 35A, 35B coupled to extension sections 34A, 34B of arms 20A, 20B. Pads 35A, 35B are situated at the distal ends 30A, 30B of arms 20A, 20B and extend between the arms 20A, 20B. Pads 35A, 35B contact one another when the distal ends 30A, 30B of arms 20A, 20B are aligned to provide space between the arms 20A, 20B so that support leg 16 is not pinched between the arms 20A, 20B when flashlight 10 is gripped by a user.

Hub sections 32A, 32B each form a cavity 38A, 38B that extend along pivot axis 18. Cavities 38A, 38B are round and are defined by bearing surfaces 40A, 40B that include grooves 42A, 42B. Bearing surfaces 40A, 40B contact an outer surface 15 of axle 14 so that the hub sections 32A, 32B are in rotative bearing engagement with axle 14. Grooves 42A, 42B formed in bearing surfaces 40A, 40B receive protrusions 17A, 17B that extend out from the outer surface 15 of axle 14 so that hub sections 32A, 32B are locked on to axle 14 when flashlight 10 is assembled. In operation, hub sections 32A, 32B may be separated from axle 14 so that each light generator 12A, 12B may be used by two users. In the illustrative embodiment, the ends 14A, 14B of axle 14 are lightly interference fit with the bearing surfaces 40A, 40B of hub sections 32A, 32B so that axle 14 provides a frictional arm-support means configured to support the arms 20A, 20B in a position selected by a user when a user pivots one or both of arms 20A, 20B about axle 14.

In some alternative embodiments, the ends of axle 14 and hub sections 32A, 32B may be formed to include corresponding teeth to support the arms 20A, 20B when positioned by a user relative to axle 14. In other embodiments, magnets (not shown) may be mounted in each of hub sections 32A, 32B in order to couple light generators 12A, 12B when brought together. In some such embodiments, axle 14 may be metallic or magnetic to couple each light generator 12A, 12B to axle 14 when flashlight 10 is assembled. In other embodiments, one or more complementary mechanical tabs and tab receivers (not shown) may be included in first light generator 12A, second light generator 12B, and axle 14 to couple each light generator 12A, 12B to axle 14 when flashlight 10 is assembled. In still other embodiments, another locking mechanism such as a set screw may support the arms 20A, 20B when positioned by a user relative to axle 14.

Figure 1:
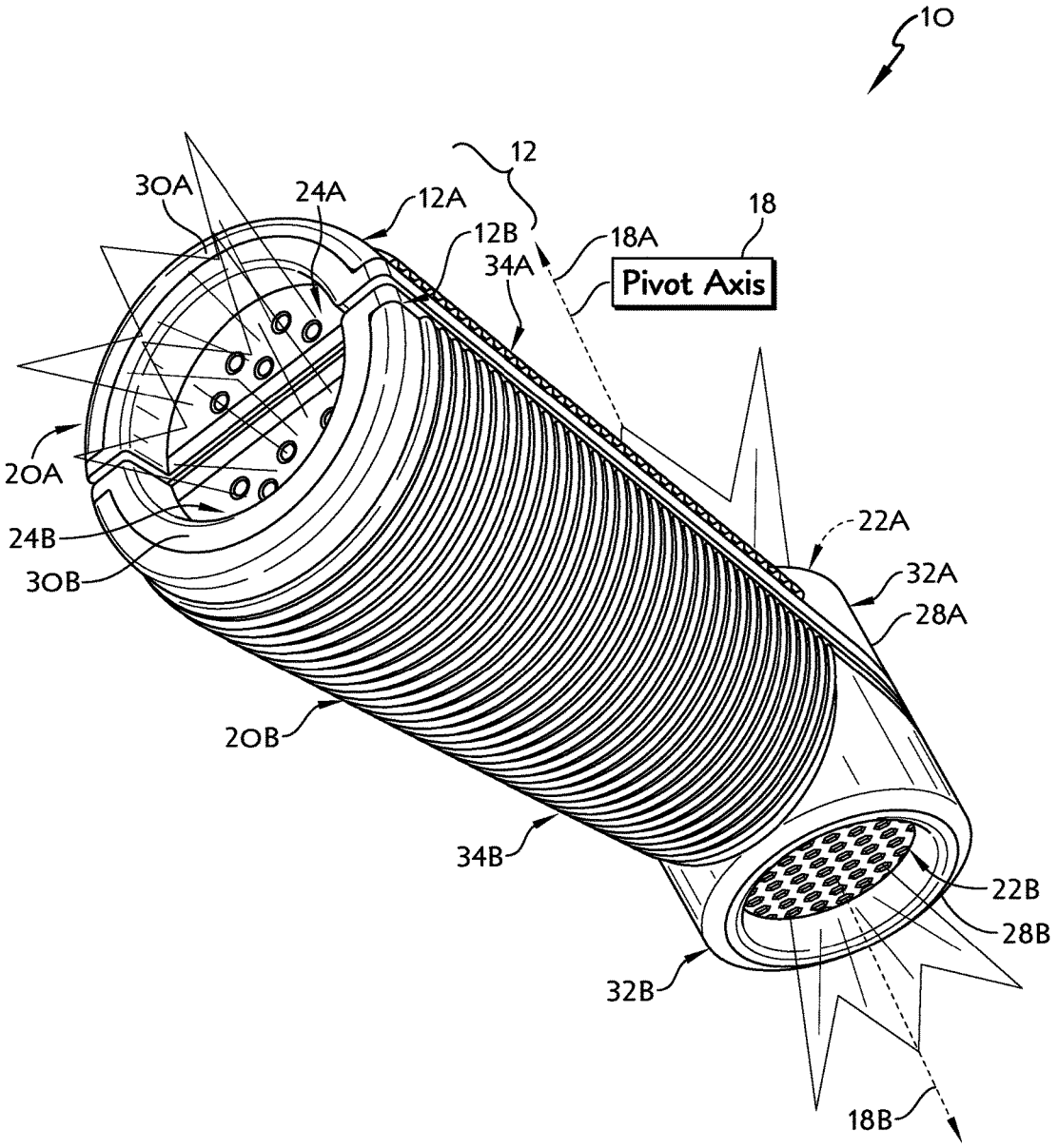
FIG. 1 is a perspective view of a flashlight including cylindrical body formed by a first light generator and a second light generator pivotable relative to one another about a pivot axis as shown in FIG. 3, each light generator including an axial light source for projecting light along the pivot axis and a movable light source, spaced apart from the pivot axis, for projecting light perpendicular to the pivot axis.

Axial light sources 22A, 22B are configured to emit light along pivot axis 18 as shown in FIG. 1. Axial light sources 22A, 22B of the illustrative embodiment are a number of LEDs (light emitting diodes) that are low powered to provide a glow effect for lantern or night light use. In other embodiments, axial light sources 22A, 22B may be full power LEDs or other light emitting devices.

Movable light sources 24A, 24B are configured to emit light in a direction perpendicular to pivot axis 18 as shown in FIG. 1. Movable light sources 24A, 24B of the illustrative embodiment are a number of LEDs configured to provide projected light for illuminating objects at a distance from flashlight 10. In other embodiments, movable light sources 24A, 24B may be other light emitting devices.

Power systems 26A, 26B included in light generators 12A, 12B are configured to allow a user to activate axial light sources 22A, 22B and movable light sources 24A, 24B in any combination. Power systems 26A, 26B each include a power source 44A, 44B and a rotary switch 46A, 46B as shown diagrammatically in FIG. 5. Power sources 44A, 44B are electrically coupled to rotary switches 46A, 46B and are configured to selectively power light sources 22A, 22B, 24A, 24B. Power sources 44A, 44B in the illustrative embodiment are replaceable batteries but could be rechargeable batteries. As a result of each light generator 12A, 12B having an independent power source, one of the light generators 12A, 12B may act as a backup or emergency light in the event that one power source runs out of charge. Rotary switches 46A, 46B are coupled to axial light sources 22A, 22B and movable light sources 24A, 24B. Rotary switches 46A, 46B are configured to selectively connect power sources 44A, 44B to axial light sources 22A, 22B and/or movable light sources 24A, 24B.

Figure 5:
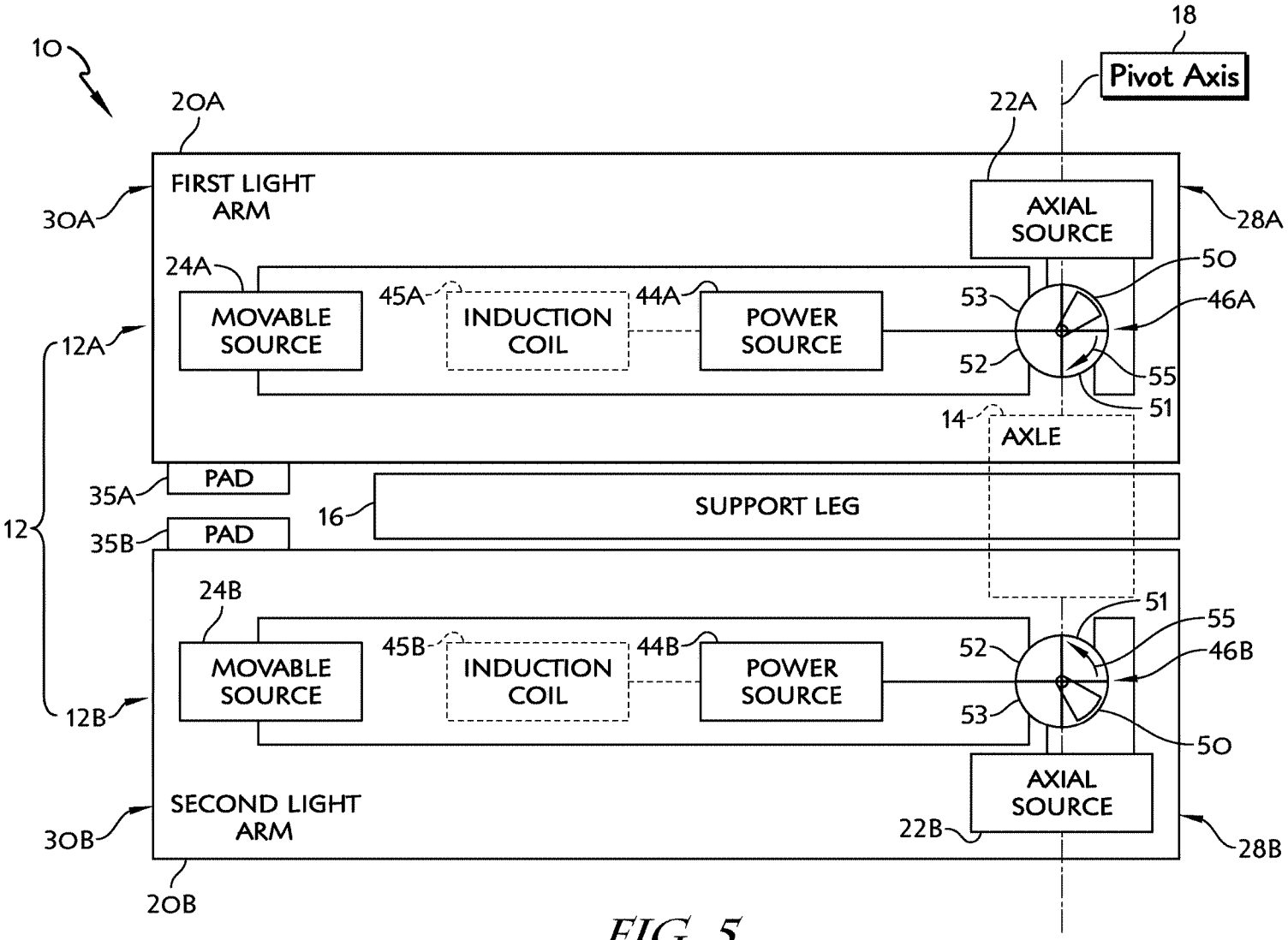
FIG. 5 is a diagrammatic view of the flashlight of FIG. 1 showing that each of the light generators is electrically independent of the other light generator and that each light generator includes a power source and a rotary switch configured to move between an off configuration, an axial-light-on configuration, a movable-light-on configuration, and an all-light-on configuration.
Figure 6:
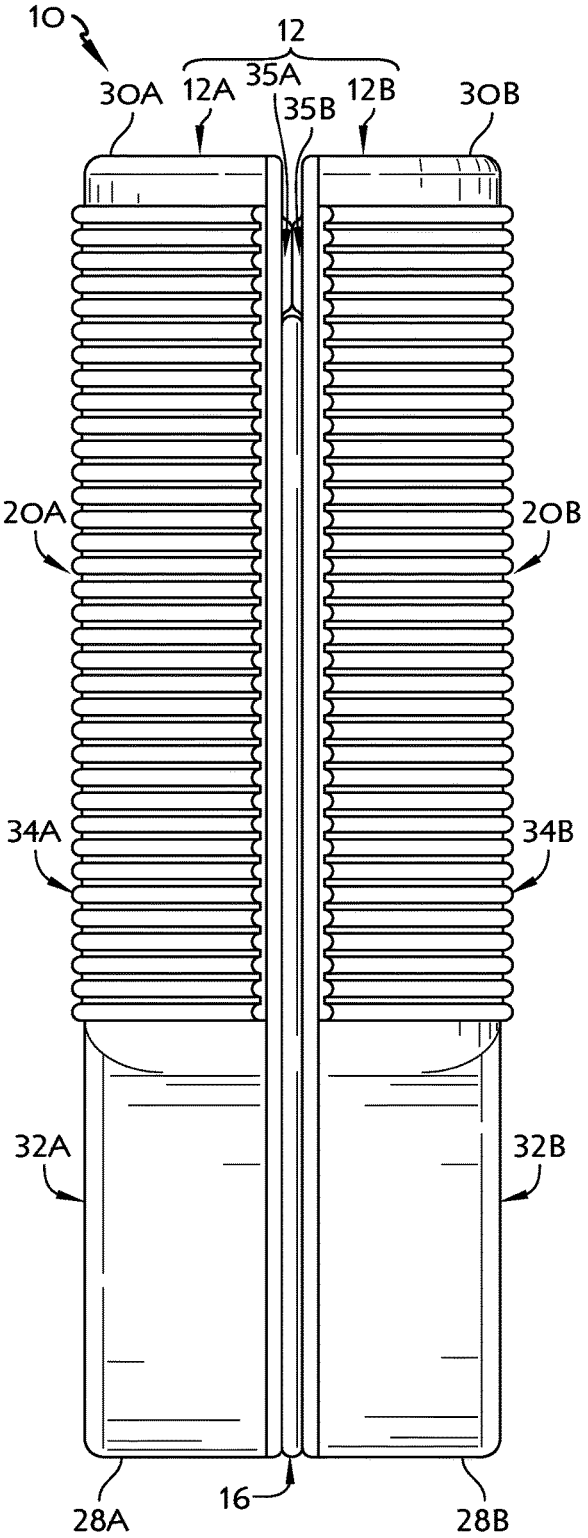
FIG. 6 is a front elevation view of the flashlight of FIG. 1 showing that the first and the second light generators each include an arm and a pad configured to contact the pad of the other of the first or the second light generators when distal ends of the light generators are aligned with one another so that the support leg is not pinched between the first light generator and the second light generator.
Figure 7:
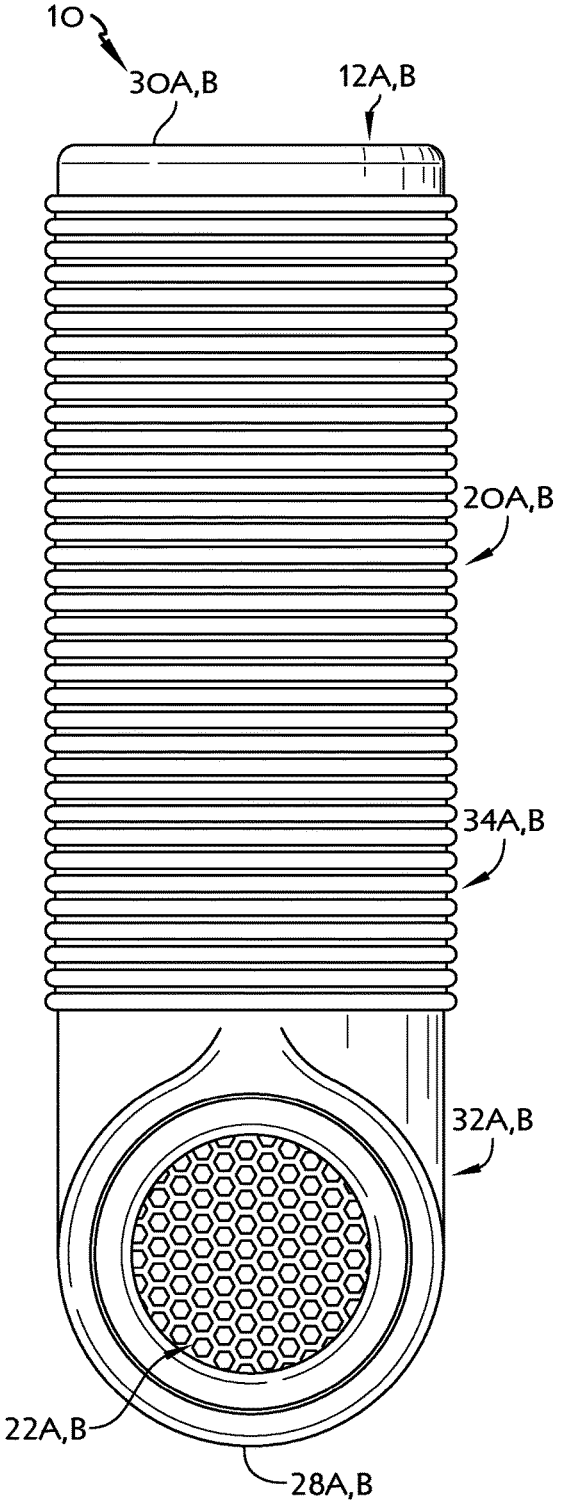
FIG. 7 is a side elevation view of the flashlight of FIG. 1 showing that the arms of each of the first and the second light generators are formed to allow light from the axial light source to be emitted.

In some embodiments in which power sources 44A, 44B are rechargeable batteries, power systems 26A, 26B may also include charge coils 45A, 45B as shown in phantom in FIG. 5. Charge coils 45A, 45B are illustratively induction coils coupled to power sources 44A, 44B. Charge coils 45A, 45B are configured to recharge power sources 44A, 44B when charge coils 45A, 45B are moved into proximity with powered induction coils.

Rotary switches 46A, 46B of the illustrative embodiment each move through four configurations 50, 51, 52, 53 to disconnect and connect power source 44A, 44B with one or both of axial light source 22A, 22B and one or both of movable light source 24A, 24B. Each rotary switch 46A, 46B changes configuration as suggested by arrow 55 in response to a user pressing on the corresponding axial light source 22A, 22B. In a first configuration 50, rotary switch 46A, 46B couples power source 44A, 44B to open so that neither axial light source 22A, 22B nor movable light source 24A, 24B is powered. In a second configuration 51, rotary switch 46A, 46B couples power source 44A, 44B to axial light source 22A, 22B but not movable light source 24A, 24B so that only axial light source 22A, 22B is powered. In a third configuration 52, rotary switch 46A, 46B couples power source 44A, 44B to movable light source 24A, 24B but not axial light source 22A, 22B so that only movable light source 24A, 24B is powered. In a fourth configuration 53, rotary switch 46A, 46B couples power source 44A, 44B to both movable light source 24A, 24B and axial light source 22A, 22B so that both axial light source 22A, 22B and movable light source 24A, 24B are powered. Thus, any combination of one or more light sources 22A, 22B, 24A, 24B included in body 12 can be powered as desired by a user.

Figure 10A:
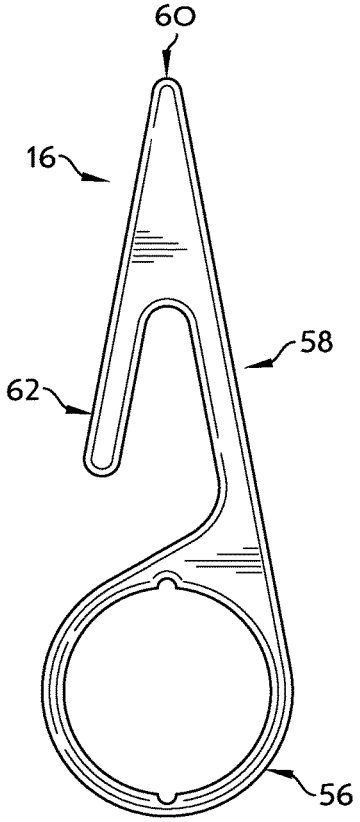
FIG. 10A is a side elevation view of the support leg of FIG. 2 showing that the support leg forms a hook that can be used to hang the flashlight from a wire, a nail, or the like so that the flashlight is self-supporting.

Support leg 16 is a monolithic plastic component formed to include a hub 56 and a strut 58 as shown, for example, in FIG. 10A. In other embodiments, support leg 16 may be a metallic component. Hub 56 of support leg 16 is situated between hubs 40A, 40B of first and second light generators 12A, 12B. In the illustrative embodiment, hub 56 is lightly interference fit with other surface 15 of axle 14 so that support leg 16 is held in place relative to axle 14 when positioned by a user. Strut 58 in the illustrative embodiment is triangular and forms a hook 62 and a rounded point 60.

Figure 2:
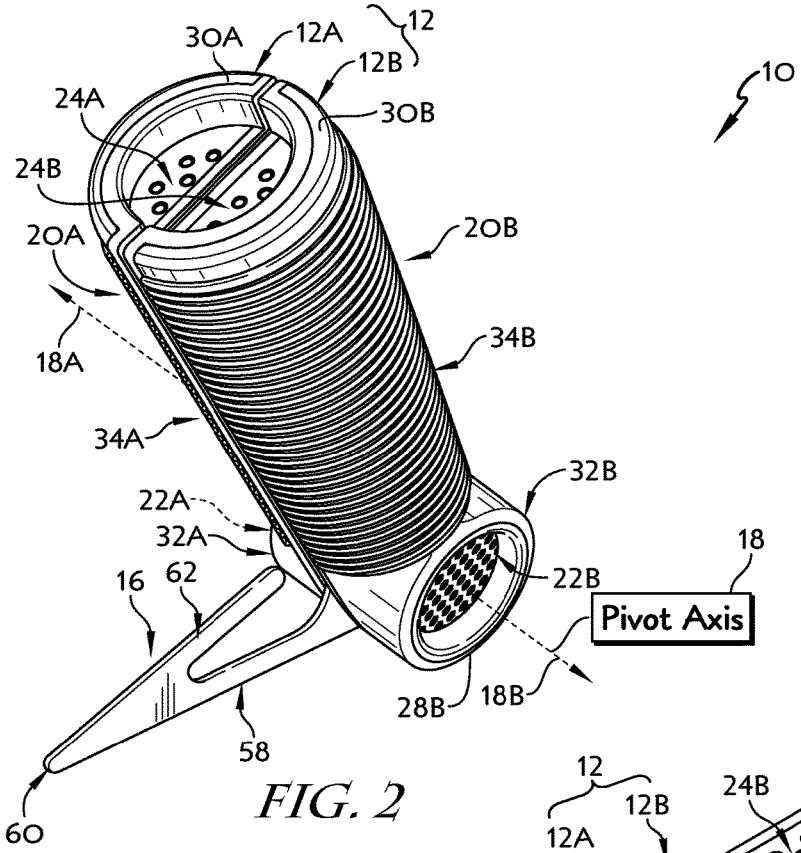
FIG. 2 is a perspective view of the flashlight of FIG. 1 showing that the flashlight also includes a support leg situated between the first light generator and the second light generator and configured to pivot about the pivot axis from a stowed position, located between the first light generator and the second light generator, and a use position, arranged to extend out from between the first light generator and the second light generator to support the body such that the flashlight is self-supporting when placed on a flat surface.

Support leg 16 pivots between a stowed position, shown in FIG. 1, and a use position, shown in FIG. 2. In the stowed position, support leg 16 is positioned so that both hub 56 and strut 58 are situated between first light generator 12A and second light generator 12B so that support leg 16 is out of the way when flashlight 10 is gripped by a user. In the use position, support leg 16 is pivoted anywhere up to 360° about pivot axis 18 so that strut 58 extends out from between first and the second light generator 12A, 12B to provide support for flashlight 10. When support leg 16 is moved to the use position, flashlight 10 is configured to be self-supporting when placed on a flat surface. In some embodiments, a plurality of support legs 16 may be included in flashlight 10. In such embodiments, each support leg 16 may have different features formed in the strut 58 such as saw teeth, bottle openers, blades, or the like.

Flashlight 10 is also self-supportive by rotating either light generator 12A, 12B so that a light generator 12A, 12B is parallel to a flat surface and positioning the other of light generator 12A, 12B to emit light in a user selected direction. First light generator 12A or second light generator 12B arranged parallel with a flat surface can independently support the other light generator 12A, 12B or can increase stability of support from support leg 16 when support leg 16 is positioned to support body 12 of flashlight 10.

Support leg 16 may also be used so that flashlight 10 is self-supporting when used outdoors or with a supporting protrusion (not shown). Rounded point 60 of strut 58 can be driven into the ground or an object so that body 12 of flashlight 10 may be supported in place by support leg 16. Hook 62 of strut 58 can be hooked to a supporting protrusion such as a cable, a tree branch, or a nail in a wall so that body 12 of flashlight 10 may be supported relative to the supporting protrusion.

Figure 8:
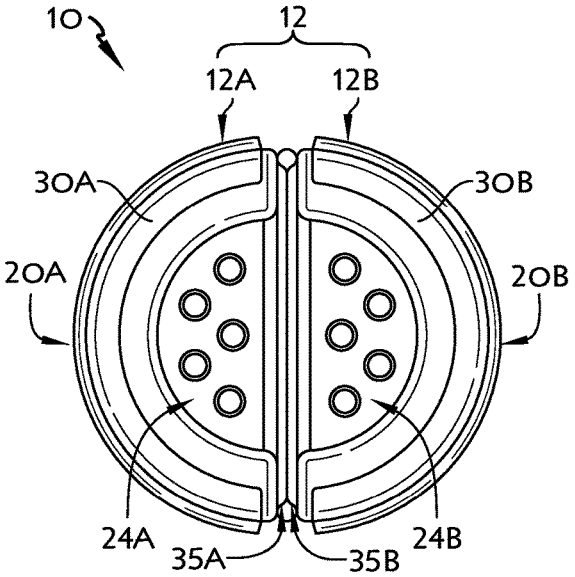
FIG. 8 is a top plan view of the flashlight of FIG. 1 showing that each of the movable light sources includes an illustrative number of LEDs (light-emitting diodes)
Figure 9:
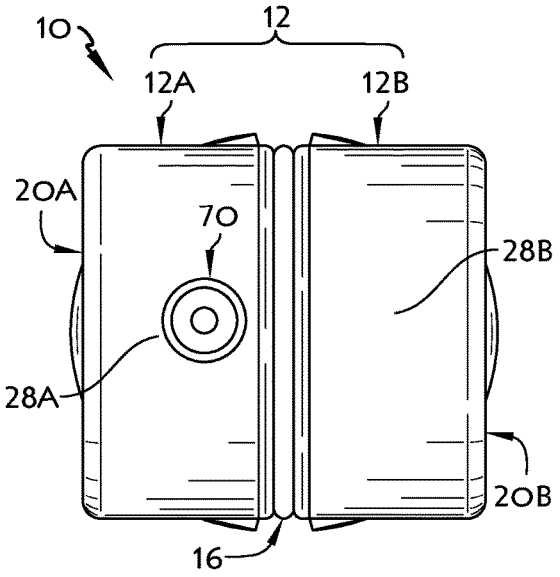

A tapped orifice 70 is coupled to the arm 20A of the first light generator 12A at the proximal end 28A of the arm 20A as shown in FIG. 8. The tapped orifice 70 is configured to allow a keychain, a carabineer, or the like to be coupled to flashlight 10.

Figure 3:
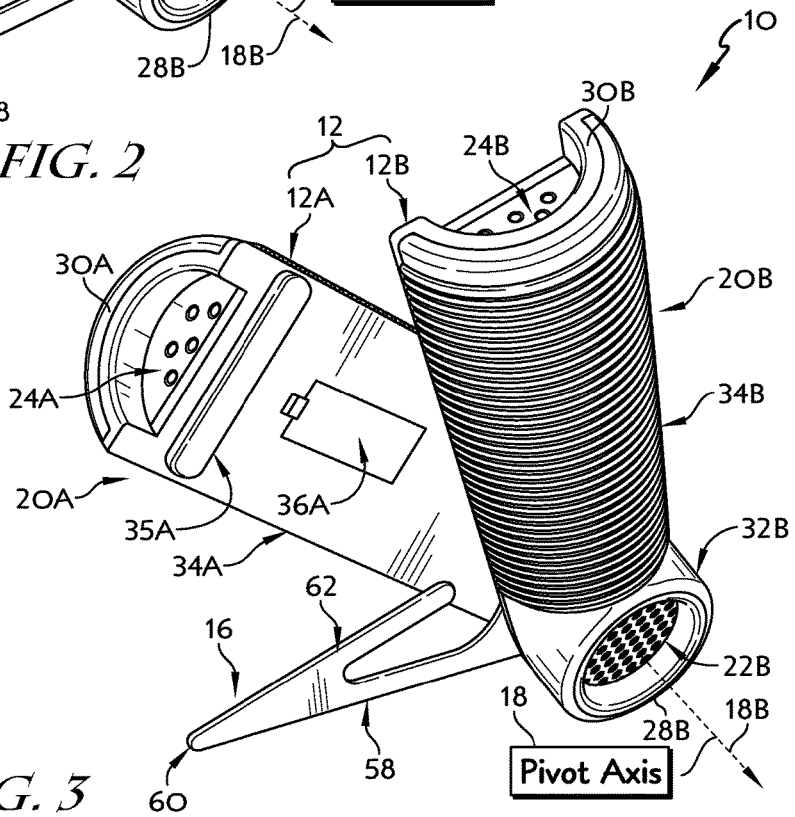
FIG. 3 is a perspective view of the flashlight of FIG. 2 showing the second light generator pivoted about the pivot axis so that the movable light sources included in the first light generator and the second light generator are arranged to emit light streams in different directions perpendicular to the pivot axis.

In operation, movable light source 24A of first light generator 12A and movable light source 24B of second light generator 12B can emit light streams in different directions. Second light generator 12B moves between an aligned position and a number of misaligned positions relative to first light generator 12A. When second light generator 12B is aligned with first light generator 12A as shown in FIG. 2, movable light source 24A, 24B of each light generator 12A, 12B are pointed in the same direction and the intensity of both movable light sources 24A, 24B can be aimed in one general direction. When second light generator 12B is pivoted to one of the misaligned positions relative to first light generator 12A by pivoting one of the light generators 12A, 12B about axle 14 as shown in FIG. 3, flashlight 10 can emit light streams in more than one general direction so that a user can illuminate a greater area or two separate areas in two different directions.

In illustrative embodiments, a user can grip first light generator 12A while pivoting second light generator 12B between the aligned position and one of the misaligned positions. Thus, flashlight 10 can be user-supported while the light generators 12A, 12B are adjusted relative to one another. Also, flashlight 10 can be user-supported by one light generator 12A, 12B while emitting light streams in more than one general direction so that a user can illuminate a greater area or two separate areas in two different directions.

Axial light sources 22A, 22B can also emit light in opposing directions along pivot axis 18 so that flashlight 10 can emit light streams in up to four different directions. Axial light source 22A of first light generator 12A is arranged to emit light in a first direction 18A along pivot axis 18 and axial light source 22B of second light generator 12B is arranged to emit light in a second direction 18B, opposite the first direction 18A. Thus, flashlight 10 may emit light in up to four general directions when second light generator 12B is in one of the misaligned positions relative to first light generator 12A and all light sources 22A, 22B, 24A, 24B are powered.

In illustrative embodiments, a user can activate and direct movable light sources 24A, 24B to illuminate a subject or subjects spaced from himself and can activate at least one of axial light sources 22A, 24B to illuminate himself. Users such as policemen, firefighters, and other emergency personnel may activate axial light sources 22A, 22B to illuminate themselves while illuminating a subject with movable light sources 24A, 24B so that the user is identifiable by others nearby. Similarly, a user can illuminate himself using one movable light source 24A, 24B while illuminating a subject with the other of movable light source 24A, 24B by misaligning the second light generator 12B relative to the first light generator 12A.

Figure 10B:
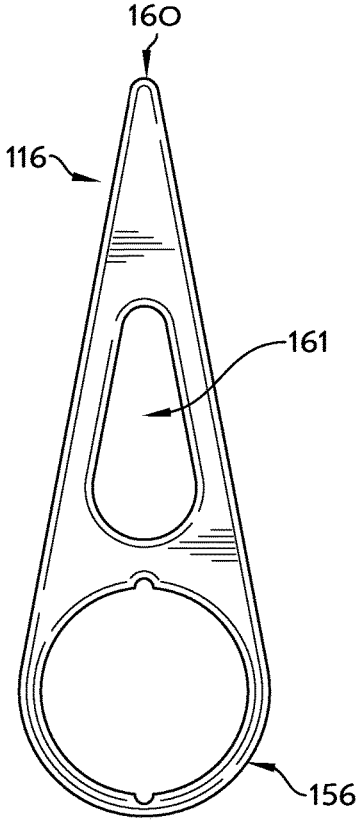
FIG. 10B is a side elevation view of an alternative support leg suitable for plunging into uneven ground, a tree, or other available objects so that the flashlight is self-supporting.

An alternative support leg 116 is a monolithic plastic component as shown in FIG. 10B. Support leg 116 includes a hub 156 and a strut 158. Strut 158 forms a rounded point 160 and an opening 161 that can be used to thread a support line (not shown) through opening 161 such that a flashlight (not shown) including support leg 116 can be self-supporting when threaded over the line. Support legs 16 and 116 may be interchangeable by a user depending on user needs.

Figure 11:
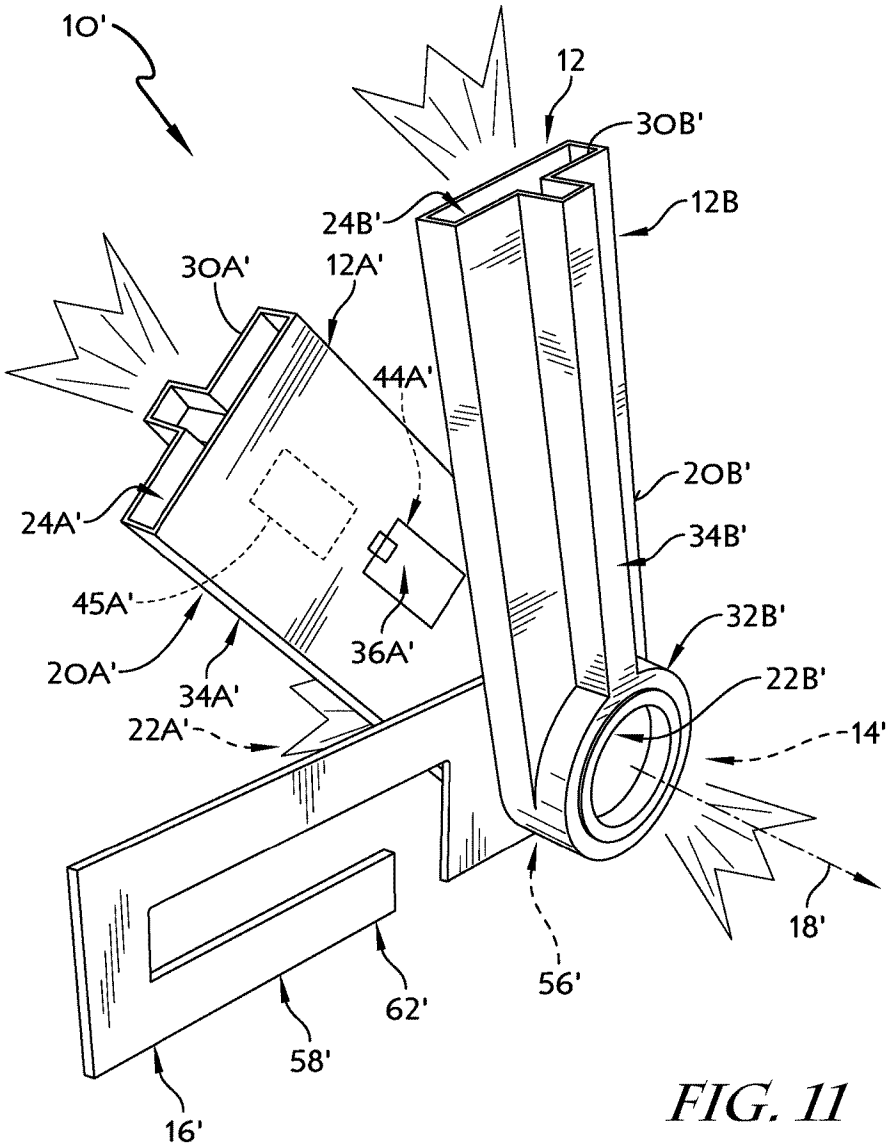
FIG. 11 is a perspective view of an alternative flashlight embodiment including a body formed by a first light generator, a second light generator, and a support leg arranged to support the first and the second light generators on a flat surface or to couple the first and the second light generators to a support base to form a lamp as shown in FIG. 13.

An alternative flashlight 10', substantially similar to flashlight 10, is shown in FIG. 11. Because alternative flashlight 10' is substantially similar to flashlight 10, similar reference numerals in the (') series have been used denote like features and the discussion of the features of flashlight 10 is hereby incorporated by reference into the description of flashlight 10' (except where such discussion contradicts description specific to flashlight 10' herein).

Figure 12:
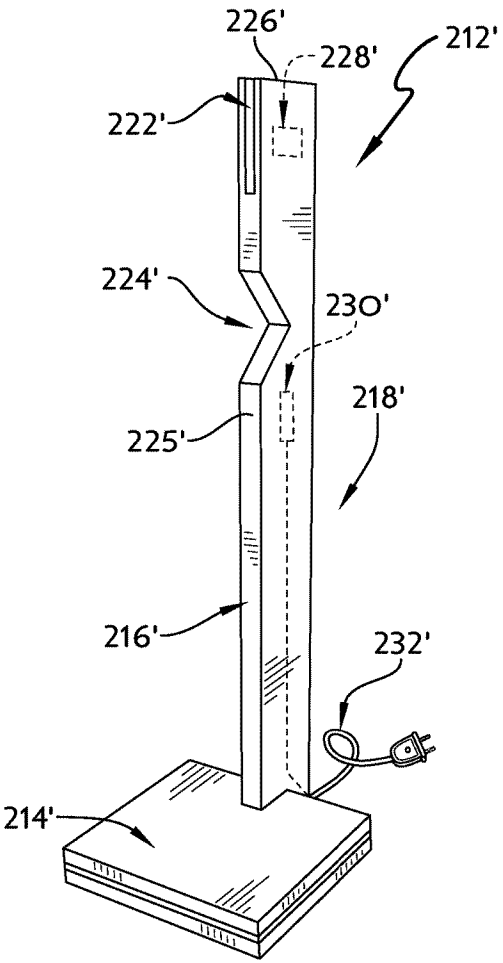
FIG. 12 is a perspective view of a support base configured for use with the flashlight of FIG. 11 to provide a lamp showing that the support base includes a pedestal, a column arranged to extend upwardly from the pedestal, and a power coil housed in the column to charge batteries included in each light generator when the light generator is moved to a charge position as suggested in FIGS. 14 and 15.
Figure 13:
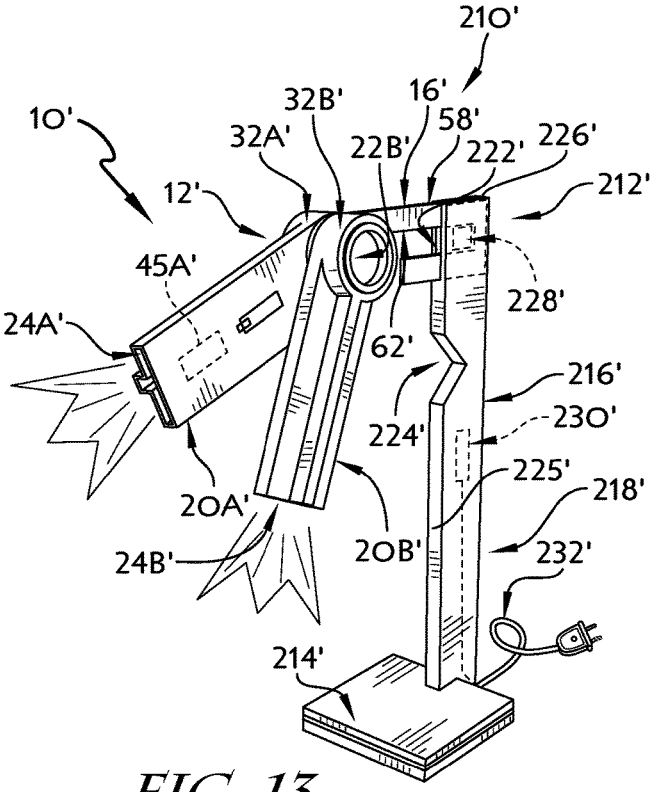
FIG. 13 is a perspective view of a lamp provided by coupling the flashlight of FIG. 11 to the support base of FIG. 12 showing the support leg coupled to the column of the support base, the first light generator moved to use position shining light in a first direction, and the second light generator moved to another use position shining light in a second direction.
Figure 14:
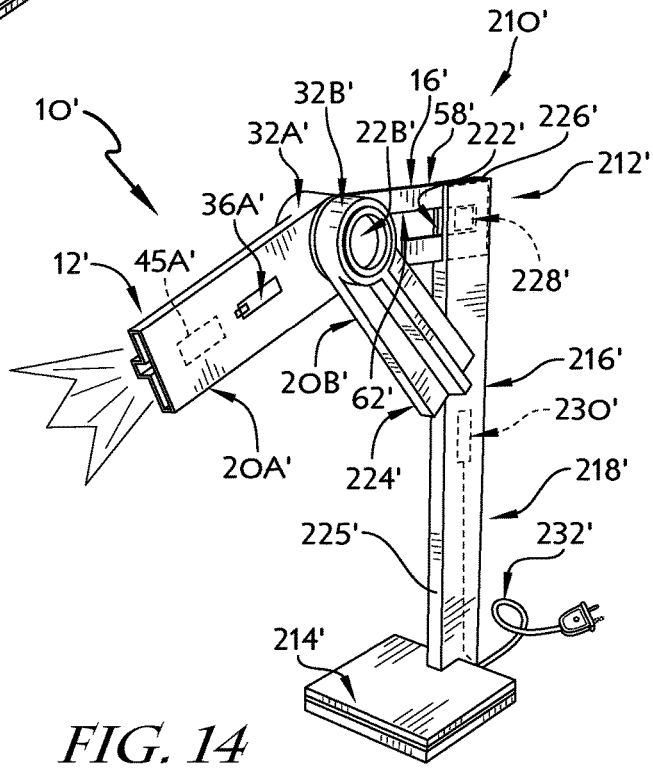
FIG. 14 is a perspective view of the lamp of FIG. 13 showing that each light generator includes charging coils coupled to the batteries internal to each light generator to charge the batteries when the charging coils are located near a power coil internal to the support base, and showing that the second light generator has been pivoted from the use position to a charge position in which the charging coil of the second light generator is charged by the power coil of the support base so that the battery of the second light generator is recharging.
Figure 15:
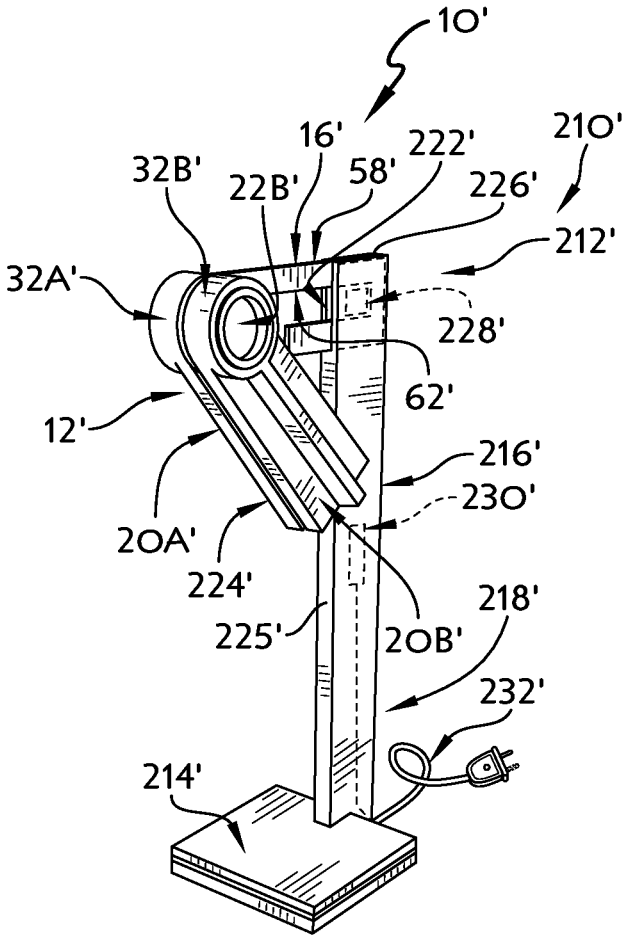
FIG. 15 is a is a perspective view of the lamp of FIGS. 13 and 14 showing the first light generator pivoted from the use position to a charge position in which the charging coil of the first light generator is charged by the power coil of the support base so that the battery of the first light generator is recharging.

Flashlight 10' is configured for use on its own or with a support base 212', shown in FIG. 12, as part of a lamp 210' shown in FIGS. 13-15. Flashlight 10' illustratively includes a body 12', an axle 14', and a support leg 16' as shown in FIG. 11. Support leg 16' is coupled to first and second light generators 12A', 12B' to pivot about a pivot axis 18' defined by an axle 14' and forms a rectangular hook 62' as shown, for example, in FIG. 11. Support leg 16' provides prop means coupled to first and second light generators 12A', 12B' for supporting first and second light generators 12A', 12B' relative to a surface when first and second light generators 12A', 12B' are arranged in preselected positions at an angle with the surface by a user as shown in FIG. 11. Thus first and second light generators 12A', 12B' continue to provide light in predetermined directions corresponding to the preselected positions without the user holding first and second light generators 12A', 12B' or support leg 16' as shown, for example, in FIG. 11. Support leg 16' also provides a connection means for mounting flashlight 10' to support bases 212' as shown, for example, in FIG. 13.

Support base 212' illustratively includes a pedestal 214', a column 216' and a charging system 218' as shown in FIG. 12. Pedestal 214' is configured to be placed on a surface and is sized to counterbalance flashlight 10' when flashlight 10' is mounted to support base 212' to form lamp 210'. Column 216' extends upwardly from pedestal 214' and is configured to couple to support leg 16' when flashlight 10' is mounted to support base 212'. Charging system 218' is configured to recharge the power sources 44A', 44B' of flashlight 10' when flashlight 10' is mounted on support base 212'.

Column 216' is formed to include a slot 222' sized to receive support leg 216' of flashlight 10' and a notch 224' configured to receive distal ends 30A, 30B of light generators 12A, 12B as shown in FIGS. 14-15. Slot 222' is arranged to extend downwardly from a top surface 226' of column 216 as shown in FIG. 12. A rectangular peg 228' extends through slot 226' and is sized to be received in hook 62' formed by the support leg 16' as shown, for example, in FIG. 13. When support leg 16' is received in slot 226' and peg 228' is received in the hook 62' of support leg 16, flashlight 10' is mounted to support base 212' as shown, for example, in FIG. 13. Notch 224' is arranged to extend inwardly from a front surface 225' of column 216' and is located between slot 222' and pedestal 214' in an axial direction.

Charging system 218' is configured to charge the power sources 44A', 44B' of first and second light generators 12A', 12B'. Charging system 218' illustratively includes a power coil 230' and a power cable 232' as shown in FIG. 12. Power coil 230' is illustratively an induction coil powered through power cable 232' which plugs into a wall socket. Power coil 230' is illustratively housed in column 216' and is arranged adjacent to notch 224'.

First and second light generators 12A', 12B' are coupled to axle 14' for movement about pivot axis 18' and each moves from a number of use positions to a charge position. In the use positions, distal end 30A', 30B' of first and/or second light generators 12A', 12B' are spaced apart from column 222' and are arranged to emit light from movable light sources 24A', 24B' in a predetermined direction. In the charge position, distal end 30A', 30B' of first and/or second light generators 12A', 12B' are located adjacent to column 222' and are received in notch 224' of column 216' as shown in FIGS. 14 and 15. When first and/or second light generators 12A', 12B' are in the charge position, recharge coil(s) 45A', 45B' are located near corresponding power coil(s) 45A', 45B' so that power source(s) 44A', 44B' are recharged.

The invention claimed is:

1. A flashlight comprising a first light generator including a first light source arranged to emit light along a longitudinal axis of the first light generator, a second light generator including a second light source arranged to emit light along a longitudinal axis of the second light generator, the second light generator coupled to the first light generator to pivot relative to the first light generator about a pivot axis arranged to extend perpendicular to and intersect the longitudinal axis of the first light generator and the longitudinal axis of the second light generator, and connection means for mounting the flashlight to a support base to form a lamp when the flashlight is coupled to a support base, the connection means including a support leg coupled to the first light generator for movement about the pivot axis independent of the second light generator and coupled to the second light generator for movement about the pivot axis independent of the first light generator.

2. The flashlight of claim 1, wherein the support leg is coupled to the first light generator and the second light generator for about 360° movement about the pivot axis.

3. The flashlight of claim 1, further comprising a support base formed to include a slot sized to receive the support leg and including a peg that extends through the slot sized to be received by a hook formed by the support leg.

4. The flashlight of claim 1, further comprising a support base configured to be coupled to the support leg and configured to charge a power source included in at least one of the first light generator and the second light generator, wherein the first light generator and the second light generator are each movable about the pivot axis relative to the support leg and the support base when the support leg is coupled to the support base.

5. A flashlight comprising a first light generator including a first light source arranged at a distal end of the first light generator to emit light along a longitudinal axis of the first light generator, and a second light generator including a second light source arranged at a distal end of the second light generator to emit light along a longitudinal axis of the second light generator, wherein the second light generator is coupled to the first light generator for about 360° movement about a pivot axis relative to the first light generator, the pivot axis is arranged to extend through the first light generator at a proximal end of the first light generator, and the pivot axis is arranged to extend through the second light generator at a proximal end of the second light generator.

6. The flashlight of claim 5, wherein the second light generator is coupled to the first light generator for 360° movement about the pivot axis relative to the first light generator.

7. The flashlight of claim 5, wherein the pivot axis is substantially perpendicular to the longitudinal axis of the first light generator and the longitudinal axis of the second light generator.

8. The flashlight of claim 5, further comprising an axle arranged to extend along the pivot axis, the axle coupled to at least one of the first light generator and the second light generator, and at least one of the first light generator and the second light generator are coupled to the axle to pivot about the axle.

9. The flashlight of claim 8, wherein at least one of the first light generator and the second light generator are interference fit with the axle.

10. The flashlight of claim 5, wherein the first light generator includes a third light source coupled to the proximal end of the first arm and arranged to emit light along the pivot axis in a first direction and the second light generator includes a fourth light source coupled to the proximal end of the second arm and arranged to emit light along the pivot axis in a second direction, opposite the first direction.

11. The flashlight of claim 5, further comprising a support leg coupled to the first light generator and to the second light generator for movement about the pivot axis independent of the first light generator and the second light generator.

12. The flashlight of claim 11, wherein the support leg is movable about the pivot axis from a stowed position in which the support leg is arranged to lie between the first light generator and the second light generator and a use position in which the support leg is arranged to extend out from between the first light generator and the second light generator.

13. The flashlight of claim 5, further comprising a support leg coupled to the first light generator and to the second light generator for movement about a pivot axis, wherein the support leg is coupled to the first light generator and the second light generator for 360° movement about the pivot axis relative to at least one of the first light generator and the second light generator.

14. A flashlight comprising a first light generator, a second light generator coupled to the first light generator for movement about a pivot axis that intersects the first light generator and the second light generator, and a support leg coupled to the first light generator for movement about the pivot axis independent of the second light generator and coupled to the second light generator for movement about the pivot axis independent of the first light generator.

15. The flashlight of claim 14, wherein the support leg is coupled to the first light generator and the second light generator for about 360° movement about the pivot axis relative to at least one of the first light generator and the second light generator.

16. The flashlight of claim 14, wherein the second light generator is coupled to the first light generator for about 360° movement about a pivot axis relative to the first light generator.

17. The flashlight of claim 14, wherein the pivot axis extends through the first light generator at a proximal end of the first light generator, the pivot axis extends through a proximal end of the second light generator, the first light generator includes a first light source arranged at a distal end of the first light generator, and the second light generator includes a second light source arranged at a distal end of the second light generator.

18. The flashlight of claim 17, wherein a longitudinal axis of the first light generator extends through the proximal end of the first light generator and the distal end of the first light generator, a longitudinal axis of the second light generator extends through the proximal end of the second light generator and the distal end of the second light generator, the first light source is arranged to emit light along the longitudinal axis of the first light generator, and the second light source is arranged to emit light along the longitudinal axis of the second light generator.

19. The flashlight of claim 18, wherein the second light generator is coupled to the first light generator for 360° movement about the pivot axis, the support leg coupled to the first light generator for 360° movement about the pivot axis relative to the first light generator, and coupled to the second light generator for 360° movement about the pivot axis relative to the second light generator.

20. A flashlight comprising an arm sized to be gripped in the hand of a user, and a light generator coupled to the arm for movement about a pivot axis that intersects the arm and the light generator over 360° of rotation, wherein the pivot axis extends through the arm at a proximal end of the arm, the pivot axis extends through a proximal end of the light generator, and the light generator includes a first light source arranged at a distal end of the light generator.

21. The flashlight of claim 20, further comprising a support leg coupled to the arm for movement about the pivot axis relative to the arm independent of the light source.

22. The flashlight of claim 21, wherein the support leg is coupled to the arm and the light generator for about 360° movement about the pivot axis relative to at least one of the arm and the light generator.

23. The flashlight of claim 20, wherein a longitudinal axis of the light generator extends through the proximal end of the light generator and the distal end of the light generator; and the first light source is arranged to emit light along the longitudinal axis of the light generator.

24. The flashlight of claim 23, wherein a longitudinal axis of the arm extends from the proximal end of the arm to a distal end of the arm spaced from the proximal end of the arm, the distal end of the arm is spaced about the same distance from the pivot axis as the distal end of the light generator, and the pivot axis is perpendicular to both the longitudinal axis of the arm and the longitudinal axis of the light generator.

25. The flashlight of claim 24, further comprising a support leg coupled to the arm for movement about the pivot axis relative to the arm independent of the light source and the support leg is coupled to the arm for 360° movement about the pivot axis relative to the arm independent of the light generator.

26. The flashlight of claim 20, wherein the light generator includes a second powered device arranged at the proximal end of the light generator.

27. The flashlight of claim 26, wherein the second powered device is a second light source arranged to emit light perpendicular to the longitudinal axis of the light generator.

28. The flashlight of claim 20, wherein the arm and the first light have distal ends spaced an equal distance from the pivot axis.

29. The flashlight of claim 28, wherein the arm includes a powered device arranged at the distal end of the arm.

* * * * *